US006548134B1

(12) United States Patent
Rogers

(10) Patent No.: US 6,548,134 B1
(45) Date of Patent: Apr. 15, 2003

(54) VENTED CONTAINER CONTAINING A LIQUID PRODUCT WITH PARTICULATE SOLIDS

(75) Inventor: Neil John Rogers, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/202,963

(22) PCT Filed: Jun. 23, 1997

(86) PCT No.: PCT/US97/10962

§ 371 (c)(1),
(2), (4) Date: Apr. 5, 1999

(87) PCT Pub. No.: WO97/49616

PCT Pub. Date: Dec. 31, 1997

(30) Foreign Application Priority Data

Jun. 26, 1996 (EP) ..... 96870083

(51) Int. Cl.[7] ..... B29D 22/00; B29D 23/00; B32B 1/08; B32B 3/10; B32B 3/00

(52) U.S. Cl. ..... 428/35.7; 428/36.5; 428/131; 428/315.5; 428/319.3; 220/676

(58) Field of Search ..... 428/35.2, 35.7, 428/36.5, 315.5, 319.3, 131; 220/367.1, 373, 366.1, 676, 368; 252/99

(56) References Cited

U.S. PATENT DOCUMENTS 1,389,659 A * 9/1921 Hollowood
3,351,497 A * 11/1967 Lucas ..... 136/178
3,557,989 A * 1/1971 Balda ..... 215/56
4,269,722 A * 5/1981 Joshi et al. ..... 252/90
4,873,012 A * 10/1989 Broze et al. ..... 252/99
6,073,812 A * 6/2000 Wade et al. ..... 222/189.09

FOREIGN PATENT DOCUMENTS

| | | | |
|---|---|---|---|
| DE | 86 21 927.8 | 10/1986 | |
| DE | 86 22 818.8 | * 8/1989 | ..... B65D/51/16 |
| EP | 0 482 274 A1 | 4/1992 | |
| EP | 0 543 443 A3 | 5/1993 | |
| EP | 0 729 901 A1 | 9/1996 | |
| WO | WO 94/03580 | 2/1994 | |
| WO | WO 94/26614 | * 11/1994 | ..... B65D/51/16 |
| WO | WO 96/24534 | 8/1996 | |

* cited by examiner

*Primary Examiner*—Harold Pyon
*Assistant Examiner*—Michael C. Miggins
(74) *Attorney, Agent, or Firm*—Thibault Fayette; Jerry J. Yetter; Kim William Zerby

(57) ABSTRACT

The present invention relates to a container (10) containing a liquid product. The container enables the venting of the liquid product by a venting means. The venting means allows the passage of gases between the interior and the exterior of the container when the pressure inside the container differs from the ambient pressure. The venting means is permeable to gases, but impermeable to the liquid product. The liquid product comprises particulate solids selected from the group consisting of carbonate, percarbonate, perborate and mixtures thereof. The size of the particulate solids is not greater than 400 $\mu$m.

10 Claims, 2 Drawing Sheets

VENTED CONTAINER CONTAINING A LIQUID PRODUCT WITH PARTICULATE SOLIDS

FIELD OF THE INVENTION

The present invention relates to a container, which comprises a venting means.

BACKGROUND OF THE INVENTION

The problem of container deformation in response to pressure differences existing between the inside of a closed container and the ambient pressure is well known in the packaging industry. Such container deformation may be non-recoverable for certain container materials, like some plastics or metals. Thin-walled, partially flexible containers are particularly sensitive to the problem.

There are a number of possible factors which may lead to the existence of the pressure differences between the interior and the exterior of the container mentioned above. The content of the container may, for example, be chemically unstable or may be subject to reaction with gases which may exist in the head space of the container, or alternatively, in certain specific circumstances, may react with the container material itself. Any chemical reactions involving the liquid contents may lead to either production of gases, and hence to over-pressure in the container, or to the absorption of any head space gases thereby causing under-pressure in the container.

Pressure differences between the pressure inside the container and the ambient atmospheric pressure may also occur when the temperature during the filling and sealing of the container is significantly different from external temperature during shipment, transportation and storage. Another possibility of a pressure difference may be caused by a different ambient pressure at the filling of the container from another ambient pressure at a different geographical location.

The prior art has proposed several solutions using valve systems which avoid pressure differences between the interior and the exterior of the container. Proposed solutions also relate to various venting caps which allow pressure generated inside the container to be released by escape of gas. For example, FR-A-2,259,026, U.S. Pat. No. 4,136,796 and DE-A-2,509,258 disclose self-venting closures comprising a gas-permeable membrane covering an orifice to the exterior. The membranes are made of a material which is impermeable to liquids, but permeable to gases. Therefore, containers may comprise apertures to release gas to the exterior without losing their leak-tightness. Another example is EP-A-593,840 which discloses containers for containing liquids which generate pressure, the container being made of a thermoplastic material comprising a network of micro-channels. This network of micro-channels is permeable to gases, but not to liquids.

It has been found that should liquid product contact these membranes, or the extremity of micro-channels, the membranes may lose at least part of their gas-permeability. Specifically, liquid products comprising particulate solids such as carbonate and/or percarbonate and/or perborate suspended in the liquid product may not completely drain away from the membrane back into the container. Instead it has been found that the pores of the membrane are clogged by these particulate solids sedimented out of the liquid. In this manner, it may happen that the container loses venting capacity. This loss of venting capacity results in a pressure difference between the exterior and the inside of the container which may deform the container.

The contact between the product and the membrane may be caused by splashes of the product onto the membrane as the filled container is agitated during shipment and transportation of the container. It has been found that the amount of splashes normally occurring during shipment and transportation are sufficient to completely interrupt the venting capacity of the container. Another means by which product may contact with the membrane is during an upside down storage of the container. It has been further found that other venting systems, like valves for example, may also suffer from a similar disadvantage.

As mentioned before, an important parameter which influences the venting capacity of the membrane is that the product which has contacted the membrane may sediment out some particulate solids suspended in the product. It is therefore an object of the present invention to provide a container containing a liquid product, the liquid product comprising particulate solids, the container allowing venting of the product by venting means, whereby the sedimentation of the particulate solids from the liquid product onto the venting means is substantially reduced.

SUMMARY OF THE INVENTION

The present invention provides a container containing a liquid product. The container enables the venting of the liquid product by a venting means. The venting means allows the passage of gases between the interior and the exterior of the container when the pressure inside the container differs from the ambient pressure. The venting means is permeable to gases, but impermeable to the liquid product. The liquid product comprises particulate solids selected from the group consisting of carbonate, percarbonate, perborate and mixtures thereof. The size of the particulate solids is not greater than 400 $\mu$m.

DETAILED DESCRIPTION OF THE INVENTION

In the following, the FIGS. 1*a* to 1*c* refer to a portion of a container. With the term "container", it is herein understood to encompass any hollow body able to contain liquid products and any other parts of a container when the container is closed. Such other parts may be a closure, e.g. a cap or a lid, which is releasably engageable with the container and which allows the closing and the opening of the container. The closure is preferably engaged in a leak tight manner with the container. The closure may be of the screw-on/in or snap-on/in type. Further flip-top, push-pull or turret cap closures may be possible closures of the container.

Figure 1A:
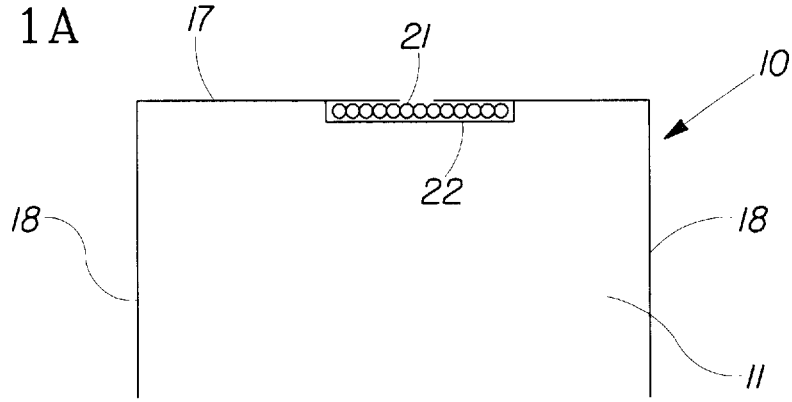
FIGS. 1*a*, 1*b* and 1*c* illustrate cross sectional side views of different embodiments of containers (partially shown) according to the present invention comprising a venting means.
Figure 1B:
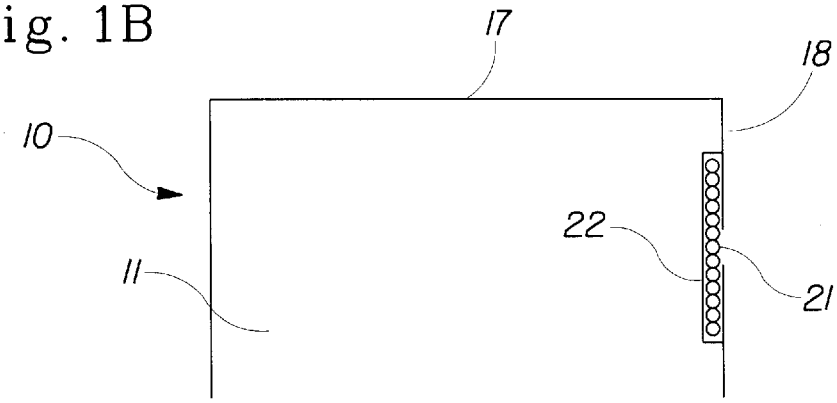
Figure 1C:
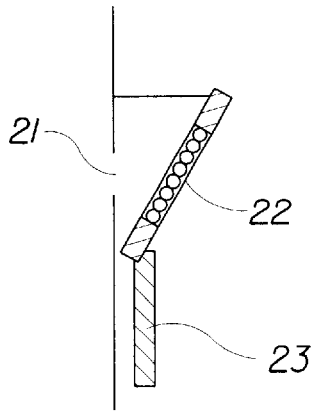

FIG. 1*a* shows a cross sectional side view of a container, wherein the container (10) (only partially shown) comprises a hollow body (11). The hollow body comprises a side wall (18) and a bottom wall (not shown in FIG. 1*a* ). The container further comprises a top wall (17) when the container is closed. The hollow body is able to contain any liquid products. Preferably, the hollow body is flexible to an extent that it may deform in response to pressure differences arising between the inside of the container and the ambient pressure. Pouches made of thin plastic material, for example, are also encompassed by the present invention. Otherwise, suitable shapes of the container may include essentially cylindrical, tapered cylindrical, oval, square, rectangular or flat-oval.

In a preferred embodiment of the present invention, the container (10) comprises a spout. Preferably, the container is made of plastic, metal, paper, or combinations of these materials as layers, laminates or co-extrudates. The materials may be also recycled. Preferred materials for the container and parts thereof include plastics such as polyethylene (high or low density), polyvinyl chloride, polyester, polyethylene terephthalate (=PET), extrudable PET, polypropylene, polycarbonate and nylon. These plastics may be used individually or be combined as co-extrudates, layers or laminates.

As another essential feature, the container (10) comprises a venting means (20). The venting means is able to equalize the pressure inside the container to the external atmospheric pressure. Consequently, the venting means is able to avoid over-pressure as well as under-pressure inside the container. Indeed, the venting means allows the escape of gases released from the contained product from the inside to the outside of the container, or vice versa. The venting means is located in the upper portion of the container above the level of the contained product, when the container is in its upright position. Indeed, the gases causing the over-pressure or under-pressure accumulate in the upper region of the container. Therefore, the passage of gases to the exterior or interior is facilitated.

Preferably, the venting means comprises at least an orifice (21) and a membrane (22). The orifice connects the interior of the container with the exterior. Specifically, the orifice (21) allows the passage of gases from the interior to the exterior of the container, or vice versa, such that pressure inside the container is either maintained identical to the external atmospheric pressure or at a pressure at least below the pressure at which significant bottle deformation occurs. The orifice may be located on the top wall or the side wall. As another preferred option, the orifice is part of a separate part of the hollow body (11) of the container, whereby the part can be attached or engaged onto the hollow body, such as a closure. The dimension of the orifice should be suitable for the passage of gases.

The membrane (22) covers the orifice and is located between the content of the hollow body (11) and the orifice (21) in the interior or exterior of the hollow body (11). The membrane is substantially impermeable to liquids, but permeable to gases. Therefore, the membrane is able to provide a substantially liquid impermeable barrier, while allowing gas venting. Preferably, the membrane may be substantially liquid impermeable up to pressure differences of $5–10^5$ Pa (500 mbar) between the inside and the outside of the hollow body, preferably up to pressure differences of $10^6$ Pa (1 bar). The membrane may be a planar surface, at least when viewed macroscopically. The membrane may also comprise a network of microchannels which is permeable to gases, but substantially not to liquids, as described in EP-A-593 840. The membrane may be corrugated macroscopically, like a zigzagged surface, in which case the membrane is defined by several planes of different inclination with respect to the horizontal direction, connected to each other.

Preferably, the membrane (22) is any material capable of being formed into a thin layer which may be used to cover the orifice (21). The membrane must be permeable to gas flow, also in response to small pressure differences. Preferably, the membrane should allow gas flow with pressure differences as low as $5 \cdot 10^4$ Pa (50 mbar), more preferably as low as $5 \cdot 10^3$ Pa (5 mbar). The thickness of the membrane is a matter of choice, but preferably would be in the region of 0.2 mm to 2 mm. The membrane can comprise essentially any material which may be formed into thin layers such as plastics, paper or metal having micropores. Preferred materials for the membrane include microporous plastic films. The size of the micropores of the membrane should be such so as to allow the passage of gases at low pressure differences and at the same time to provide a high level of liquid impermeability. Preferably, the micropores will be in the range of 0.1 $\mu$m to 5 $\mu$m, more preferably between 0.2 $\mu$m to 1 $\mu$m. Preferably, the membrane has a rounded shape. But other shapes, such as rectangular, triangular or else, may be also foreseen to adapt it in a container or cap and/or improve the aesthetics of the container or cap itself.

Preferred microporous plastic films for this application are:

- non-woven plastic films, especially the non-woven spun bonded polyethylene film material sold under the trade name TYVEK by the Du Pont Company, of which TYVEK, Style 10, which is fluorocarbon treated to achieve high fluid impermeability;
- an acrylic copolymer cast on a non-woven support (nylon or PET) with a hydrophobic fluoro-monomer post-treatment, sold under the trade name, VERSAPOR, by the Gelman Sciences Company, 600, South Wagner Road, Ann Arbor, Mich. 48106, US.

The microporous film material of the membrane (22) may be treated to reduce its surface energy and therefore to improve the impermeability to liquids of the film material. The lowering of the surface energy of the film material is particularly necessary to improve its impermeability when the container (10) contains products comprising surfactant components. Preferably in this case, the specific surface energy of the film material should be lower than that of the surfactant-containing product to achieve a substantially complete impermeability to the product contents. Preferably, the membrane (22) has at least one surface directed towards the liquid product inside the container which is more hydrophobic than the liquid product.

Fluorocarbon treatment, which involves fixation of a fluorocarbon material, on a micro scale, to the surface of the film material is a specific example of a treatment which provides such reduced surface energy. Indeed, the fluorination treatment reduces the susceptibility of the microporous film material of the membrane to wetting by the liquid product contents. For example, a possible fluorocarbon material for use in the fluorocarbon treatment according to the present invention is sold under the trade name SCOTCHBAN, by the 3M Company. However, when used to treat the microporous film material of the membrane according to the present invention, this fluorocarbon treatment should not compromise the gas permeability of the membrane.

The membrane (22) may be applied and located inside or outside the hollow body (11) between the content and the orifice (21) in any way that maintains its liquid-impermeability and gas-permeability according to the present invention. The means of application may therefore include the use of adhesives, or heat-sealing of the membrane onto the area around the orifice or mechanical means such as clamping or hot-stamping, or insertion of the membrane during moulding of the container. As stated before, the application means employed should not significantly compromise the venting ability of the membrane. For this reason, it is preferred that any adhesive used is also permeable to gases, or does not fill up the pores of the membrane.

As described in co-pending EP-A-0 706 954,the membrane (22) may be also fitted in a housing. Housings whose dimensions are particularly compatible for use in a container or a cap according to the present invention are commercially available from GVS, Via Roma 50, 40069, Zola Predosa (BO), Italy. In a highly preferred embodiment, the manufacture of the housing and the fitting of the membrane (22) in the housing can be achieved by an "insert moulding operation", where:

- a sheet of membrane is fed into an apparatus; the sheet of membrane is advantageously fed from a roll of membrane material;
- in the apparatus, at least one membrane is cut from the sheet and is placed into a mould wherein the housing will be formed;
- then, the housing is moulded substantially around the membrane in a manner which secures the membrane in the housing. As "Substantially around" it is meant herein that once completed, this step should generate a housing with its fitted membrane, where both surfaces of the membrane are accessible to air, but the membrane is tightly maintained in the housing.

Housings may also be manufactured by heat sealing, ultrasonic sealing or gluing the membrane (22) into the housing. Furthermore, housings may be manufactured by mechanically holding the membrane between two separate pieces whereby the pieces are clipped together.

The liquid product according to the present invention has solid suspending properties. The liquid product may be aqueous or non-aqueous. In the non-aqueous liquid product the amount of water should not exceed about 5% by weight of the liquid product, more preferably less than about 1% by weight. The particulate-containing liquid products herein will be phase stable under conditions of commercial marketing and use of such products. Furthermore, the particulate containing liquid products herein will be relatively viscous. Frequently, the viscosity of the liquid products herein will range from about 0.3 Pa·s (300 cps) to about 5 Pa ·s (5000 cps), more preferably from 0.5 Pa ·s (500 cps) to about 3 Pa ·s (3000 cps). For purposes of the invention, viscosity is measured with a Brookfield Viscometer using a RV #5 spindle at 50 rpm and at a temperature of about 20°C.

It has been found that the venting performance of the venting means (20) may be substantially reduced when the contained liquid product contacts the membrane (22). Specifically, when the liquid product comprises particulate solids suspended in the liquid product. The particulate solids according to the present invention are selected from the group consisting of carbonate, percarbonate, perborate and mixtures thereof. As explained above, the membrane is the most exposed part of the venting means towards the contained product. The contacting between the product and the membrane inside a container may mainly occur through splashes during shipment and transportation with agitation of the container. As used herein "splashing" means a non-continuous and brief contact of a liquid substance upon a surface when the liquid is agitated within the container. The splashing of the contained liquid product occurs mainly during shipment and transportation, when the risk of agitation of the container is higher.

It has been found that these membranes may lose their gas-permeability when the liquid product comprising suspended particulate solids contacts the membrane (22). Indeed, it has been found that the particulate solids according to the present invention suspended in the liquid product may sedimented out of the product and deposit on the membrane. In this manner, the membrane or part thereof may be covered by the particulate solids sedimented out of the liquid product, i.e. the venting performance of the membrane is reduced for any part of the membrane clogged by the particulate solids according to the present invention sedimented out of the liquid and not drained away from the membrane. Consequently, the venting capacity of the container is reduced or effectively lost.

The contacting between the contained liquid product and the membrane (22) occurs mainly during shipment and transportation of the container. Indeed, the liquid product splashes onto the membrane within the container when the container is agitated. It has been found that the amount of splashing normally occurring during shipment and transportation is sufficient to completely interrupt the venting capacity of the container. Another means by which product may contact with the membrane is during an upside down storage of the container. It has been further found that other venting systems, like valves for example, may also suffer from a similar disadvantage.

A possible way to remove the splashed product from the membrane is to scrape the surface of the membrane splashed by the product. It has been found that the venting capacity of the membrane recovered sufficiently to prevent significant bottle deformation once the splashed product was scraped from the surface of the membrane. The scraping of the surface may be achieved with a device having the form of a shovel, for example. Although this solution solves the problem of the present invention, it has two major disadvantages. Firstly, the scraping action has to be carried out either manually by the user, which is inappropriate, or by a mechanical moving device within the container, which may be complex and expensive. Secondly, the action of scraping the splashed product from the membrane may damage the membrane. Indeed, especially the impermeability of the membrane to liquids may be easily lost through scraping. Thirdly, the action of scraping is also ineffective if the interior of the surface pores of the membrane is blocked.

The co-pending International Patent Application No. PCT/US96/01610 provides a container with venting means comprising protecting means. The protecting means protect the venting means from splashed product, e.g. with walls interposed between the product and the venting means. All the embodiments described as protecting means in the International Patent Application No. PCT/US96/01610 are herewith incorporated by reference.

Alternatively or in combination, the co-pending European Patent Application No. 95104281.1 provides a container in which the splashed product is enabled or compelled to drain away from the venting means automatically without any scraping of the venting means. This means may comprise the positioning of the venting means in an inclined or vertical plane with respect to the supporting plane upon which the container stands in its upright position, as shown for example in FIG. 1*b*. Alternatively or in combination, the means comprises a draining means (23) extending from and connected to the venting means, as shown for example in FIG. 1*c*. The draining means may also be inclined or vertical with respect to the supporting plane upon which the container stands in its upright position. The teachings of both co-pending International and European Patent Applications mentioned before can be used in the container according to the present invention to prevent the reduction of venting capacity of the venting means. All the embodiments described as draining means in the European Patent Application No. 95104281.1 are herewith incorporated by reference.

Nevertheless, it has been found that the loss of venting capacity is dependent on the tendency of the suspended particulate solids to sediment from the liquid product on to the membrane surface, thus decreasing the venting capacity. A key factor which determines the tendency for the suspended particulate solids to sediment out from the liquid product is the maximum size of the particulate solids. Indeed, if the maximum size of the particulate solids suspended in the liquid product is greater than about 400 $\mu$m, then the particulate solids sedimented out of the liquid product onto the membrane before the splashed product drains back into the container. The particulate solids sedimented out of the liquid product may clog the membrane reducing the venting capacity of the membrane itself.

Instead, if the maximum size of the particulate solids suspended in the liquid product is smaller than about 400 $\mu$m, then the particulate solids are more likely to remain suspended in the liquid product until the liquid product is drained back into the container. Accordingly, according to the present invention the maximum size of the particulate solids suspended in the liquid product is smaller than about 400 $\mu$m, more preferably smaller than about 200 $\mu$m, even more preferably smaller than about 150 $\mu$m, most preferably smaller than about 100 $\mu$m. To obtain particulate solids with a reduced maximum size, these particulate solids may be sieved and/or ground. The particulate solids having reduced maximum size according to the present invention are then added to the liquid product.

The above finding is demonstrated with the following Examples. In the following, "minors" are optional ingredients of the compositions or products such as water, stabilisers, chelating agents, radical scavengers, surfactants, bleach activators, builders, soil suspenders, dye transfer agents, solvents, brighteners, perfumes, foam suppressors, dyes and combinations thereof.

| INGREDIENTS | Example I WEIGHT PERCENT | Example II WEIGHT PERCENT |
|---|---|---|
| Sodium C12–14 Alkyl Ethoxy (3x) Sulphate | 18.3 | 18.3 |
| C12–14 Alkyl Glucose Amide | 8.1 | 8.1 |
| C12–14 Alcohol Ethoxylate (5x) | 16.8 | 16.8 |
| Butoxy Propoxy Propanol | 14.3 | 14.3 |
| Quaternized Polyethoxylated Hexamethylene Diamine Chloride salt | 2 | 2 |
| Acetyl Triethyl Citrate | 10.4 | 10.4 |
| Sodium Carbonate | 8.0 | 8.0 |
| Percarbonate | 10.0 | 0.0 |
| Perborate | 0.0 | 10.0 |
| Minors | 12.1 | 12.1 |

Both sodium carbonate, percarbonate and perborate are suspended as solid components in this liquid product. About 1.5% of the sodium carbonate solid particles and about 1.5% of the percarbonate solid particles of Example I have a maximum size of greater than 400 $\mu$m. About 1.5% of the sodium carbonate solid particles and about 1.5% of the perborate solid particles of Example II have a maximum size of greater than 400 $\mu$m.

| INGREDIENTS | Example III WEIGHT PERCENT | Example IV WEIGHT PERCENT |
|---|---|---|
| Sodium Tripolyphosphate | 25 | 25 |
| Sodium Silicate | 5 | 5 |
| Carboxymethyl Cellulose | 1 | 1 |
| Titanium Dioxide | 1 | 1 |
| Ethylene Diamine Tetra Acetic acid | 1 | 1 |
| Polyethylene Glycol (Molecular Weight 200) | 40 | 40 |
| Alcohol Ethoxylate | 10 | 10 |
| Sodium Perborate | 10 | 0.0 |
| Sodium Percarbonate | 0.0 | 10 |
| Sodium Carbonate | 5 | 5 |
| Minors | 2 | 2 |

The maximum size of sodium carbonate and perborate suspended as solid components in the liquid product of Example III is sieved to obtain a maximum size distribution of between 200 $\mu$m and 400 $\mu$m. The sodium carbonate and percarbonate of Example IV is less than 100 $\mu$m.

Figure 2C:
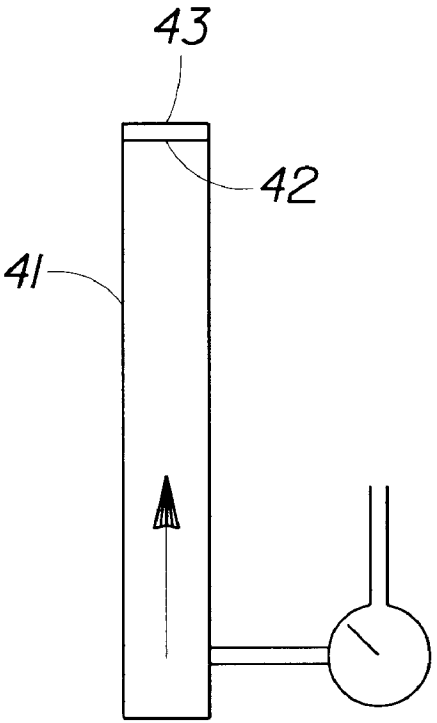
FIGS. 2*a* to 2*c* show the sequence of the bubble point test method to measure the venting capacity of a venting means contacted with a liquid product according to the present invention.
Figure 2B:
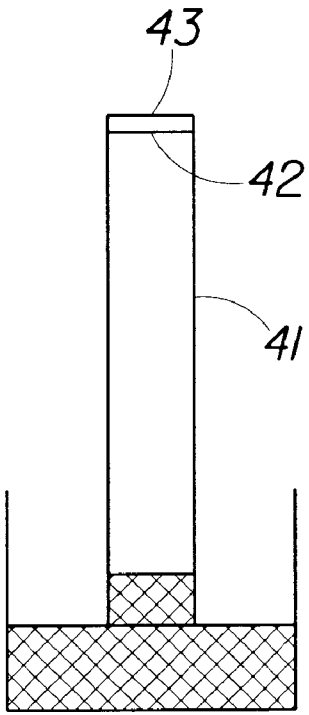
Figure 2A:
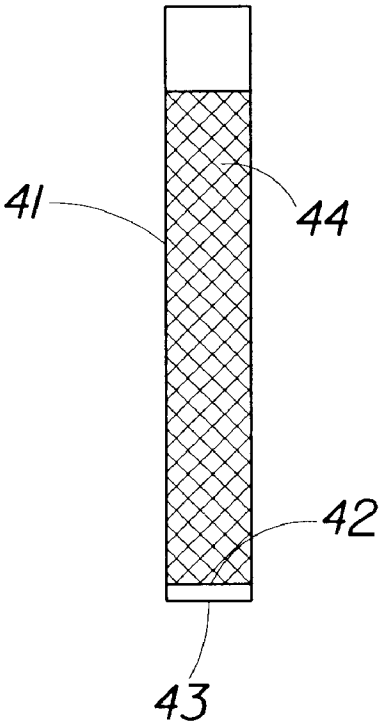

Following is the test used to measure the venting capacity of the membrane after splashes with the liquid products of the above Examples. As depicted in FIGS. 2*a* to 2 *c*, a membrane of the type Versapor®V800 OR closes one open end of a cylindrical tube (41). Thus the membrane comprises an inner surface (42) directed towards the inside of the cylindrical tube, whereas the opposite outer surface (43) is completely outside the cylindrical tube. This membrane undergoes repeated splashes (FIG. 2*a*) with a liquid product (44), whereby the liquid product stays on the inner surface for 1 minute. Afterwards, the splashed liquid product is let to drain away from the membrane for 24 hours by turning the inner surface upside down. Finally, the venting pressure is measured after 24 hours drainage using a bubble point method.

The "bubble point method", mentioned above, comprises the following steps:

- placing a thin layer of water over the outer surface (43) of the membrane closing one open end of the cylindrical tube (41);
- increasing the pressure in the tube at a rate of 100 mbar per minute;
- recording the pressure at which air bubbles are seen to come through the membrane. This detected pressure defines the venting pressure above.

The pressure measured with the bubble point method is correlated to the venting capacity of the venting means. Indeed, the higher the pressure measured the lower is the venting capacity. On the contrary, the lower the pressure measured the higher the venting capacity.

The following Table summarizes the results of the venting capacity measurements with the liquid products of Example I to III.

TABLE

| | |
|---|---|
| EXAMPLE I | >200 mbar |
| EXAMPLE II | >200 mbar |
| EXAMPLE III | 30–60 mbar |
| EXAMPLE IV | 30–60 mbar |

As can be seen from the Table, the liquid product of Examples I and II comprising particulate solids with particle maximum sizes of greater than 400 $\mu$m shows a substantially reduced venting capacity. However, the maximum size of particulate solids is reduced according to the present invention, as in Examples III and IV, the venting capacity of the membrane is sufficiently maintained.

What is claimed is:

1. A container comprising flexible walls made of a deformable material, said container comprising a liquid product, the container enabling the venting of the liquid product by a venting means, the venting means for allowing the passage of gases between the interior and the exterior of the container when the pressure inside the container differs from the ambient pressure, the venting means further being permeable to gases, but impermeable to the liquid product, the liquid product comprising particulate solids selected from the group consisting of carbonate, percarbonate, perborate and mixtures thereof, the particulate solids being suspended in the liquid product, wherein the maximum size of the particulate solids is not greater than 400 $\mu$m, and wherein said venting means is in an inclined or perpendicular position with respect to the supporting plane upon which the container stands in its upright condition.

2. A container according to claim 1 wherein the maximum size of said particulate solids is smaller than about 200 $\mu$m.

3. A container according to claim 2 wherein the maximum size of said particulate solids is smaller than about 100 $\mu$m.

4. A container according to claim 1 wherein said venting means comprises an orifice connecting the interior with the exterior of said container and a membrane covering at least partially said orifice.

5. A container according to claim 4 wherein said membrane is a microporous film.

6. A container according to claim 5 wherein said membrane has micropores of sizes in the range of 0.1 $\mu$m to 5 $\mu$m.

7. A container according to claim 4 wherein said membrane has at least one surface directed towards the liquid product inside the container which is more hydrophobic than the liquid product.

8. A container according to claim 1 wherein said venting means further comprises a draining means extending from and connected to said venting means, and wherein said draining means extends in an inclined or vertical direction with respect to the supporting plane upon which said container stands in its upright position.

9. A container according to claim 1 wherein the venting means further comprises protecting means.

10. A container according to claim 1 wherein said walls are made of at least one layer of material wherein said material is selected from the group consisting of low density polyethylene, high density polyethylene, polyvinyl chloride, polyester, polyethylene terephthalate, extrudable polyethylene terephthalate, polypropylene, polycarbonate, nylon and any combination thereof.

* * * * *